US005108008A

United States Patent [19]

Ryder

[11] Patent Number: 5,108,008

[45] Date of Patent: Apr. 28, 1992

[54] COLLAPSIBLE TUBE END TIE

[75] Inventor: Francis E. Ryder, Arab, Ala.

[73] Assignee: Ryder International Corporation, Arab, Ala.

[21] Appl. No.: 596,194

[22] Filed: Oct. 11, 1990

[51] Int. Cl.[5] ..... B65D 35/32

[52] U.S. Cl. ..... 222/99; 132/247; 206/820

[58] Field of Search ..... 222/99; 24/30.5 P; 132/246, 247, 248; 206/343, 345, 820

[56] References Cited

U.S. PATENT DOCUMENTS

| | | | |
|---|---|---|---|
| 951,132 | 3/1910 | Kinsey | 222/99 |
| 1,945,932 | 2/1934 | Caley | 132/247 |
| 2,364,596 | 12/1944 | Archer | 132/247 |
| 2,370,910 | 3/1945 | Maxwell | 132/247 |
| 2,378,872 | 1/1946 | Stone | 132/247 |
| 2,411,336 | 11/1946 | Reiter | 132/248 |
| 2,415,914 | 2/1947 | Silverman | 132/247 |
| 2,484,050 | 10/1949 | Rivard | 132/247 |
| 2,862,647 | 12/1958 | Dietz | 222/99 |
| 2,903,162 | 8/1959 | Regan | 222/99 |
| 3,186,415 | 6/1965 | Teopilian | 132/248 |
| 3,467,246 | 9/1969 | Long et al. | 206/820 |
| 4,807,782 | 2/1989 | Meinerding et al. | 222/107 |

*Primary Examiner*—Kevin P. Shaver
*Assistant Examiner*—Gregory L. Huson
*Attorney, Agent, or Firm*—Trexler, Bushnell, Giangiorgi & Blackstone, Ltd.

[57] ABSTRACT

A retaining device integrally formed of a single piece of resiliently flexible material for retaining a flattened and rolled portion of a collapsible tube in a rolled condition. The retaining device is formed with two body portions, a first portion which is attached to an end of a tube, and a second portion which acts as a shackle to retain the tube in a rolled up condition. The second portion is integrally attached to the first portion an one end thereof and is releasably engageable with the first portion at an opposite end thereof. The retaining device has a perimeter which is shaped to permit interlocking of a plurality of the retaining devices when the retaining devices are juxtaposed in alternating directions forming a tessellation in a continuous strip of resiliently flexible material.

5 Claims, 1 Drawing Sheet

Fig. 1
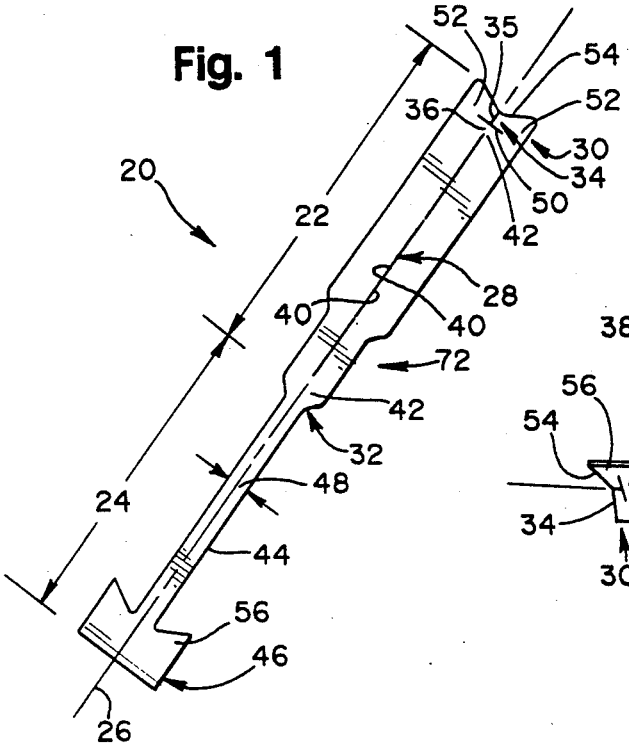
Fig. 2
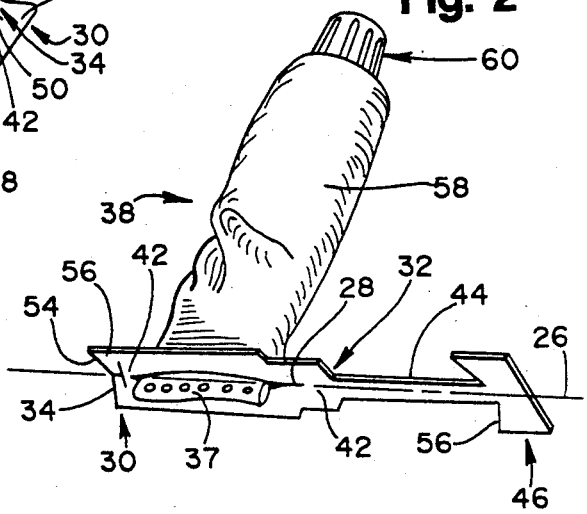
Fig. 5
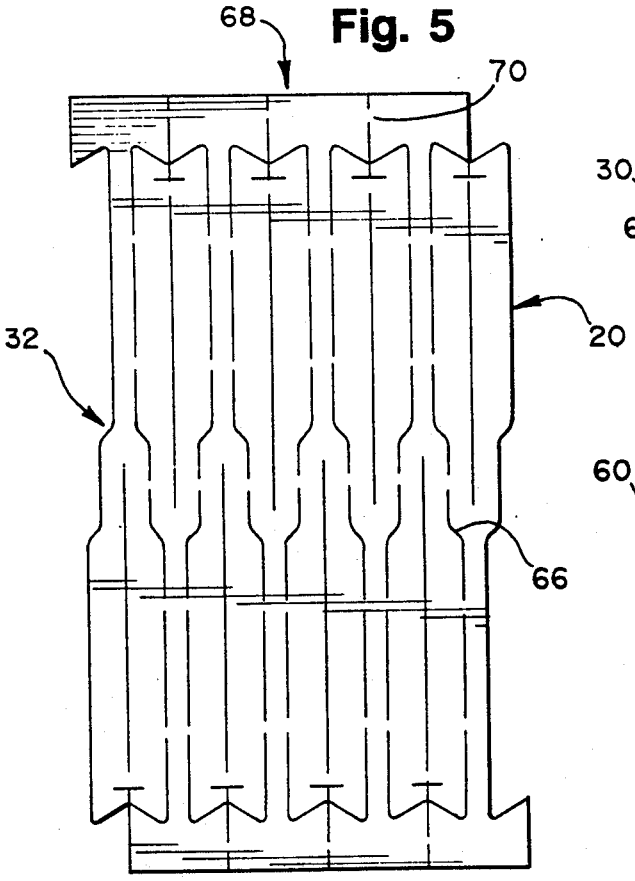
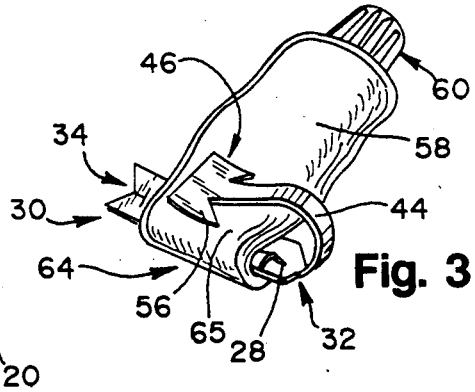
Fig. 3
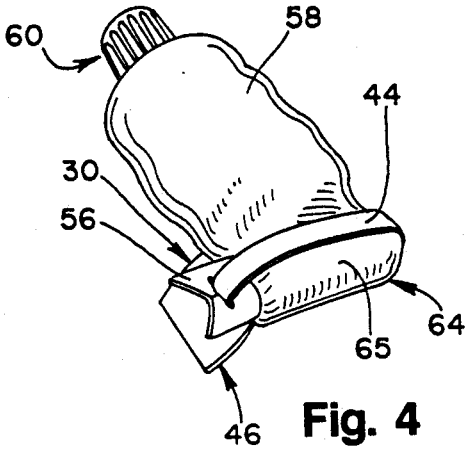
Fig. 4

COLLAPSIBLE TUBE END TIE

BACKGROUND OF THE INVENTION

This invention relates generally to a retaining device for retaining a collapsible tube in a rolled condition.

Collapsible tubes are well known in the container art for packaging semi-liquid or paste-like products. Collapsible tubes provide a convenient package which can be filled with the semi-liquid or paste-like material such as toothpaste in a mass production process. These tubes are formed of plastic coated flexible metal based materials or plastic. The metal based materials become prone to rupture upon repeated flexing or crinkling and tend to retain a shape into which it is squeezed. The tubes made of plastic materials do not rupture as readily as metal tubes and have shape memory which tends to return the tube to its original shape after squeezing. The tube is filled with material through a large end which is sealed by way of adhesive, heat sealing or folding and crimping. A reduced diameter cap end is formed with an aperture opposite the large end to provide controlled dispensing of the material therein.

Material is dispensed from the tube by removing a cap covering the cap end and squeezing the tube to force the material out through the uncovered cap end aperture. The amount of force required to dispense material from the tube depends in part on the viscosity of the material inside the tube and the amount of pressure applied to the tube. As a result of repeated use, a portion of the total volume of the material retained in the tube is dispensed. The plastic tubes tend to return to the "as formed" shape leaving a void inside of tube. The void is filled with air which may damage the portion of the material remaining in the tube. Further, if a metal based tube is repeatedly folded or crinkled while squeezing the tube may tear along stress points developed therein.

Unless a tube is systematically rolled up while dispensing, it becomes increasingly difficult to force a desired amount of material out of the tube since the paste-like material is non-uniformly distributed in the void or between opposed collapsed walls. Dispensing of the remaining volume of the material retained in the tube becomes more difficult as the remaining volume decreases with each use. Often a user will squeeze a middle portion of the tube resulting in collapse of the middle portion as opposed to the tail being collapsed. Failure to maintain the tube in a condition where the remaining material is urged towards the cap may result in damage to the tube upon repeated use or wasting of the material retained inside of the tube.

Attempts have been made to overcome the above-noted problems by providing devices which roll up the collapsed portion of the tube from a tail portion. Rolling up the exhausted portion of the tube in an organized manner assures that the maximum volume of the material retained in the tube is dispensed therefrom by forcing material from between collapsed walls towards the cap end. Further, organized rolling up of the exhausted portion of the tube prevents damage or rupture of the tube walls in metal tubes which could be caused by repeated flexing of the tube material resulting from attempts to squeeze or compress already compressed or distorted tube walls.

An example of a device employed in rolling up collapsible tubes is shown in U.S. Pat. No. 951,132 to Kinsey. The device shown in Kinsey is a key-like device which has a long narrow slot axially formed in a shaft portion for receiving an end of the tube. The end of the tube retained in the slot is rolled by axially rotating the shaft thereby rolling up the exhausted portion of the tube in an organized manner.

A device shown in U.S. Pat. No. 2,903,162 to Regan performs the same purpose in a similar way. However, the device in Regan provides a key which winds up the collapsed tube and also which locks the tube in the rolled up condition to prevent unraveling of the roll. The unraveling preventing function of this device is desirable. Unravelling may occur when pressure on the tube creates a back pressure on the material forcing the material in to the rolled portion or when the memory of the tube material returns the tube to the "as-formed" shape. While such an unraveling function is desirable, such a device is relatively expensive to produce and employs multiple discrete parts some of which are moving parts.

OBJECTS AND SUMMARY OF THE INVENTION

A general object of the present invention is to provide a strap-like restraining device which may be employed in retaining an exhausted portion of a collapsible tube in a rolled up condition.

It is another object of the present invention to form the retaining device of a single piece of resiliently flexible material to eliminate the necessity for any moving parts.

It yet another object of the present invention to provide a retaining device which may be formed in a tessellation on a continuous strip of suitable material to eliminate scrap or waste materials.

Briefly, and in accordance with the foregoing, the present invention comprises a retaining device integrally formed of a single piece of resiliently flexible material for retaining a flattened and rolled portion of a collapsible tube in a rolled condition. The retaining device is formed with two body portions, a first portion which is engaged with an end of a tube, and a second portion which acts as a shackle and engages the first portion to retain the tube in a rolled up condition. The second portion is integrally formed with the first portion and is releasably engageable with the first portion at an opposite end. The retaining device has a perimeter which is shaped to permit interlocking of a plurality of the retaining devices during production. The shape orients the retaining devices in juxtaposed alternating directions forming a tessellation in a continuous strip of resiliently flexible material.

BRIEF DESCRIPTION OF THE DRAWINGS

The organization and manner of the operation of the disclosed embodiment of the invention, together with further objects and advantages thereof, may be understood by reference to the following description taken in connection with the accompanying drawings wherein like numerals identify like elements and in which:

FIG. 1 is a plan view of a retaining device;

FIG. 2 is a perspective view of a retaining device in which a first portion is engaged with an end of a collapsible tube;

FIG. 3 is a perspective view of a retaining device attached to a collapsible tube in which an exhausted end portion of the tube has been flattened and rolled and a second portion of the retaining device is folded over the first portion and positioned for engagement therewith;

FIG. 4 is a perspective view of the tube illustrated in FIGS. 2 and 3 which has been rotated approximately 90° to illustrate engagement of the second portion with the first portion; and FIG. 5 is a plurality of retaining devices juxtaposed in alternating directions forming a tessellation in a portion of a continuous strip of material.

DESCRIPTION OF THE ILLUSTRATED EMBODIMENT

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to the embodiment illustrated and described herein.

It should be noted that dimensional relationships between members of the illustrated embodiment may vary in practice and may have been varied in the illustrations to emphasize certain features of the invention.

Referring now to the drawings wherein like parts are designated by the same reference numerals through the figures, a retaining device 20 integrally formed of a single piece of resiliently flexible material is shown in FIG. 1. The retaining device is formed with a first portion 22 and a second portion 24 which is integrally attached to the first portion 22 at one end thereof. The first and second portions 22, 24 are elongated along a common central axis 26.

A slit 28 is formed parallel to the central axis 26 along a substantial length of the first portion 22. A clasp 30 is formed on an end of the first portion 22 distal a junction 32 formed between the first portion 22 and the second portion 24. The slit 28 and a notch 34, formed in the clasp 30, are generally die cut. The slit 28 is dimensioned to permit an end portion 37 of a collapsible tube container or tube 38 (shown in FIG. 2) to be inserted therethrough. The notch 34 is generally T-shaped having a base cut 35 generally parallel to the central axis 26 and a cross-bar cut 36 generally perpendicular to the base cut 35. The cross-bar cut 36 is dimensioned to permit a portion of the second body portion 24 to be positioned and retained therein. Since edges 40 of the slit 28 are generally abutting, when the end portion 37 is inserted therethrough, tension develops in joints 42 formed at either end of the slit 28 thereby gripping the end portion 37 in the slit 28 and enhancing the engagement therewith.

The second portion number 24 includes a neck 44 and a head 46. The neck 44 attaches to the first portion number 22 at the junction 32 and the head 46 is formed on the end of the neck 44 distal the junction 32. A width dimension 48 of the neck 44 is dimensioned for engagement via the base cut 35 of the notch 34 with the cross-bar cut 36. Similar to the gripping forces between the slit 28 and the end portion 37, retention of the neck 44 in the notch 34 is enhanced by gripping forces created when the neck 44 is positioned therein. When the neck 44 is forced through the base cut 35 and into the cross-bar cut 36 the thickness of the neck forces edges 50 of the cross-bar cut 36 apart producing tension forces on inside areas 52 of the clasp 30.

Engagement of the neck 44 with the notch 34 is facilitated by gripping the head 46 and applying a force thereto and engaging the neck 44. A funneling edge 54 having a generally "V" shape is formed in the clasp 30 to direct the neck 44 into engagement with the base cut 35 of the notch 34. The head 46 is also employed when disengaging the neck 44 from the notch 34 by gripping the head 46 and applying forces thereto. The enlarged head portion 46 is formed with locking ears 56 which are angularly directed towards the first portion 22 when the retaining device 20 is viewed as in FIG. 1. As will be discussed in further detail hereinbelow, the locking ears 56 promote retention of the neck 44 in the notch 34.

As shown in FIG. 2, the collapsible tube 38 has a body portion 58 one end of which is formed with the end portion 37 and the other being formed in a cap end 60. The end portion 37 is inserted through the slit 28 and extends a distance therethrough. The central axis 26 extending through the retaining device 20 engaged with the collapsible tube 38 establishes the axis about which the body 58 of the tube will be rolled.

FIG. 3 shows the tube 38 once the body 58 has had a portion thereof rolled into a rolled portion 64. A substantial portion of the material retained inside of the tube 38 has been forced from the body 58 which has been rolled forming the rolled portion 64 thereby making dispensing of the remaining portion easier and preventing damage to the tube 38.

As further shown in FIG. 3, the second portion 24 is folded over the rolled portion 64 flexing about the junction 32 which acts as a hinge web. Positioned as such, the second portion 24 is engaged with the first portion 22. The rolled portion 64, engaged with the first portion 22, retains the first portion 22 to prevent disengagement therefrom.

Turning to FIG. 4, the neck 44 is engaged with the notch 34, more specifically, the cross-bar cut 36. The neck 44 of the second portion 24 extends over a surface 65 of the rolled portion 64 acting as a shackle to prevent unwinding of the rolled portion 64. The locking ears 56 point towards the junction 32 to prevent the neck 44 from pulling out of engagement from the clasp 30. Pull-out of the head 46 from the notch 34 is prevented by the locking ears 56 the angle of which directs the locking ears 56 downwardly along the first body portion 22 and increases the force required to pull the head 46 out of engagement with the notch 34.

FIG. 5 illustrates a series of retaining device 20 which are formed in a continuous strip of resiliently flexible material. The resiliently flexible material used in forming the present invention may be any of a variety of materials such as low density polyethylene having a suitable thickness for this application. The material used in the preferred embodiment is a low density polyethylene having a thickness of approximately 0.031 inches. This material provides suitable strength to meet the requirements of the present invention, as well as, sufficient flexibility characteristics for repeated flexing, and suitable stamping characteristics for the production of the device 20 from a continuous strip.

As shown in FIG. 5, the direction of each retaining device 20 is alternated with respect to the direction in which the head 46 is positioned. Therefore, each retaining device 20 is juxtaposed with a neighboring device positioned in the opposite direction. A perimeter 66 of each retaining device 20 is shape to permit nesting which results in a tessellation or mosaic 68 of a plurality of retaining devices 20 which completely cover a strip of resiliently flexible material without any scrap material. Attachment points 70 are spaced along the perimeter 66 of abutting portions of the retaining devices 20 to retain the retaining devices 20 in a strip as they are produced. These attachment points 70 are of a nominal dimension such that a retaining device 20 may be easily removed from a strip by pulling it off of the strip with sufficient force to tear the attachment points 70 therebetween.

In use, the retaining device 20 is engaged with an end portion 37 by inserting the end portion 37 through a slit 28 formed in the first portion 22. The body portion 58 of the tube 38 is flattened and rolled forming a rolled portion 64. The rolled portion 64 is formed by rolling the end portion 37 retained through the slit 28 about the central axis 26 of the retaining device 20. The resulting rolled portion 64 retains the first portion 22 therein as the second portion 24 is folded over the surface 65 of the rolled portion 64 about the junction 32 between the first and second portion 22, 24. Once the second portion 24 has been folded over the surface 65 of the rolled portion 64, the neck 44 is engaged with the notch 34 formed in the clasp 30. Engagement of the neck 44 with the notch 34 is achieved by positioning the neck 44 through the base cut 35 and forcing it into engagement with the cross-bar cut 36 formed generally perpendicular to the base cut 35. When the neck 44 is engaged with the notch 34, locking ears 56 formed on the head 46 help to prevent the neck 44 from pulling out of engagement with the notch 34. The angled structure of the locking ears 56 directed towards the junction 32 of the engaged first and second portions 22, 24 creates forces which resist pullout. As the contents of the tube are dispensed, the second body portion 24 is disengaged from the first 22, the rolled portion 64 is rolled as necessary and the second body portion 24 is reengaged with the first 22.

In forming the retaining devices 20, a strip of suitably resiliently flexible material is die cut to form a plurality of retaining devices 20 therein. The retaining devices 20 are formed with a perimeter 66 which is shaped to provide a tessellation 68 of alternating juxtaposed retaining devices 20 across the entire surface of the strip of material. The tessellation 68 of retaining devices 20 may be retained in a strip form after the retaining devices 20 are cut therein by attachment points 70 periodically spaced along the perimeter 66 of the retaining devices 20. The perimeter 66 or shape of the retaining devices 20 is such that the heads 46 of every other retaining device 20 abut each other and a locking ear 56 of each head nests in the "V" shaped funneling edge 54 of a third retaining device positioned therebetween. The first portion 22 is formed with a stepped down area 72 providing a transition from the first portion 22 to the second portion 24 while maintaining approximately equal thicknesses of material in the neck 44 and on each side of the slit 28 of the first portion 22 to provide sufficient strength to retain the rolled portion 64 in a rolled condition.

While a preferred embodiment of the present invention is shown and described, it is envisioned that those skilled in the art may devise various modifications of the present invention without departing from the spirit and scope of the appended claims.

The invention is claimed as follows:

1. A retaining device engageable with an end portion of a collapsible tube for retaining a flattened and rolled portion of the tube in a rolled condition, said retaining device integrally formed of an elongated single piece of resiliently flexible flat material having a first and second body portion and a central axis longitudinally extending therethrough, said retaining device being generally flattened with a top and bottom surface and a perimeter edge therearound, said first body portion including a slit formed therein along said central axis for engaging an end of a tube therethrough and a clasp portion, said clasp portion including a notch formed therein sized and dimensioned for receiving and retaining a portion of said second body portion therein; said second body portion including an elongated neck and a T-shaped head formed thereon, said elongated neck integrally formed attached to an end of said first body portion opposite said clamp, said T-shaped head being formed on said neck distal said first body portion and being sized and dimensioned for retaining said neck in engagement with said notch of said clasp portion; said notch including an axial portion and a transverse portion extending through said top and bottom surfaces, with said axial portion opening to said perimeter edge for receiving said neck therethrough; said first body portion having an end of a tube inserted through said slit and being rolled into a rolled portion of said collapsible tube, said second body portion extending from said rolled portion and folded over a surface of said rolled portion for engaging said neck in said notch by moving said neck axially from said perimeter edge along the axial portion of said notch to lock the end of the second body portion to the first body portion to prevent unrolling of said rolled portion.

2. A retaining device according to claim 1, wherein said notch is formed in said clasp portion is generally T-shaped having a base cut generally parallel to said central axis and a cross bar cut generally perpendicular to said base cut, opposed edges of said base cut and said cross bar cut generally contacting when said neck is disengaged therefrom and said cross bar cut flexibly deforming around said neck when said neck is engaged therewith.

3. A retaining device according to claim 1, wherein said head has locking ears extending away from and projecting towards said neck portion for preventing said neck from pulling out of engagement with said clasp to retain said first body portion in engagement with said second body portion.

4. A retaining device according to claim 1 further including a plurality of said retaining devices being formed from a generally continuous strip of resiliently flexible material, each of said plurality of retaining devices having a perimeter shape which interlocks with other neighboring retaining devices when said devices are juxtaposed in alternating directions, a series of retaining devices forming a tessellation in said generally continuous strip of resiliently flexible material being retained in said strip after being formed therein by more than one attachment point formed along a common perimeter between adjoining retaining devices, said strip of material having only said tessellation of alternating juxtaposed retaining devices formed therein.

5. A retaining device according to claim 2, wherein said clasp further including a funnelling edge for directing said neck into engagement with said base cut for promoting engagement of said neck with said cross bar cut of said notch.

* * * * *